United States Patent [19]

Dreisin

[11] 3,945,353

[45] Mar. 23, 1976

[54] TWO PHASE NOZZLE COOLING SYSTEM

[75] Inventor: Alexander Dreisin, Olympia Fields, Ill.

[73] Assignee: Allis-Chalmers Corporation, Milwaukee, Wis.

[22] Filed: Nov. 29, 1974

[21] Appl. No.: 528,345

[52] U.S. Cl. ..... 123/41.22; 123/41.2; 123/41.31; 123/41.33; 165/105

[51] Int. Cl.[2] ..... F01P 9/02

[58] Field of Search ..... 123/41.2, 41.22, 41.21, 123/41.31, 41.33; 165/105

[56] References Cited

UNITED STATES PATENTS

| | | | |
|---|---|---|---|
| 1,741,464 | 12/1929 | Hunt | 123/41.22 |
| 3,332,476 | 7/1967 | McDougal | 123/41.31 |
| 3,593,694 | 7/1971 | Hilborn | 123/41.31 |

*Primary Examiner*—Charles J. Myhre
*Assistant Examiner*—Daniel J. O'Connor
*Attorney, Agent, or Firm*—Arthur L. Nelson

[57] ABSTRACT

A two phase fuel injection nozzle cooling system having a hydraulically cooled heat pipe. The heat pipe contains a hermetically sealed cooling medium which has a boiling point corresponding to the upper range of acceptable nozzle operating temperatures to transfer heat from the nozzle tip to the circulating hydraulic fluid which operates as a heat sink.

11 Claims, 4 Drawing Figures

FUEL SUPPLY
FUEL PUMP
ENGINE
LUBE PUMP
II
IV

TWO PHASE NOZZLE COOLING SYSTEM

This invention relates to a fuel injection nozzle and more particularly to a two phase cooling system for a fuel injection nozzle employing a hermetically sealed heat pipe for transferring heat from the nozzle tip to a hydraulic cooling circuit to maintain acceptable operating temperatures of the fuel injection nozzle.

Diesel fuel injection nozzles in the high specific output diesel engines are exposed to heat inputs by radiation from the combustion gases and through conduction of the surrounding cylinder head metal which lead to nozzle tip temperatures exceeding acceptable limits. Fuel oil contained in the nozzle tip and subject to these high temperatures is chemically altered liberating lacquers and solid carbon particles which cause premature nozzle orifice plugging and accelerated wearing out of the needle seat in the nozzle body.

Although fuel injection nozzle cooling means have been devised in the past, they have not been entirely satisfactory. Systems cooling the fuel injection nozzle by fuel continuously circulating through the fuel injection nozzle to lower the temperature of the nozzle and improve operating conditions for fuel injection have been used. Cooling fluids can be introduced into the nozzle body whereby the heat is transferred to the cooling fluid medium and then dissipated. These types of cooling systems are usually satisfactory for the larger lower speed engines. Also the nozzle configuration may be designed to decrease the nozzle tip area exposed to the combustion gases.

The high speed diesel engines, however, have physical dimensions of the combustion chamber and engine intake and exhaust valves which limit the space available for the nozzle. Because of the space limitation, the above-described method of cooling is ineffective and unsafe.

Accordingly, this invention proposes a closed nozzle cooling system involving a two phase cooling process which has become known in the heat exchanger industry as a heat pipe. The heat pipe contains a cooling medium which has a boiling point at a temperature which corresponds to the upper range of acceptable nozzle operating temperatures. For example, for operation on diesel fuel, the desirable temperature of the nozzle tip should not exceed 400°F. The upper half of the volume in the hermetically sealed heat pipe is evacuated. An exterior cooling medium of hydraulic fluid is utilized as a heat sink to lower the temperature of the upper portion of the heat pipe below the condensation point of the interior cooling medium. For example, the engine lubricating oil can be used for this purpose. The lubricating oil under pressure is fed through the passages which surround a copper tube embracing the nozzle holder and passes through an axial passage containing the heat pipe. At this point, it flows upwardly around the pipe and out of the nozzle holder through passages back to the engine lubricating circuit. The maximum temperature of the lubrication oil in an operating diesel engine is approximately 200° to 230°F. The vaporized interior cooling medium in contact with the cooler walls of the pipe condense and return to the passage surrounding the nozzle tip, either by gravity or by means of a wicking action of the lining arranged on the interior wall of the pipe. The specific heat conduction of the two phase cooling used in this heat pipe arrangement is known to be considerably higher than heat transfer in an open system. The number of heat pipes can be multiplied around the periphery of the nozzle tip if so required.

Accordingly, it is an object of this invention to provide a fuel injection nozzle with a two phase cooling system.

It is another object of this invention to provide a two phase cooling system for a fuel injection nozzle having a hydraulic fluid cooling system for cooling a heat pipe which transfers heat from the nozzle tip to the hydraulic system.

It is a further object of this invention to provide a two phase fuel injection nozzle cooling system employing a hermetically sealed heat pipe containing a cooling medium having a boiling point of a temperature within acceptable operating ranges of the fuel injection nozzle for transferring heat from the area surrounding the nozzle tip to a hydraulic fluid cooling circuit which operates as a heat sink to dissipate heat from the nozzle holder body.

The objects of this invention are accomplished by circulating a hydraulic cooling fluid through the fuel injection nozzle holder body. The fuel injection nozzle connected to the fuel injection nozzle holder body includes passage means surrounding the nozzle tip which are in communication with a hermetically sealed heat pipe which extends into the hydraulic cooling fluid passages in the nozzle holder body. The heat pipe contains a cooling medium having a boiling point within the range of acceptable operating temperatures of the fuel injection nozzle which vaporizes and flows into a central passage of the heat pipe. The cooling medium transfers heat from the area of the nozzle tip to the hydraulic cooling fluid system to maintain acceptable operating temperatures in the nozzle tip which is adjacent to the combustion chamber and subjected to the high heat of the combustion gases.

A preferred embodiment of this invention is illustrated in the attached drawings.

Figure 1:
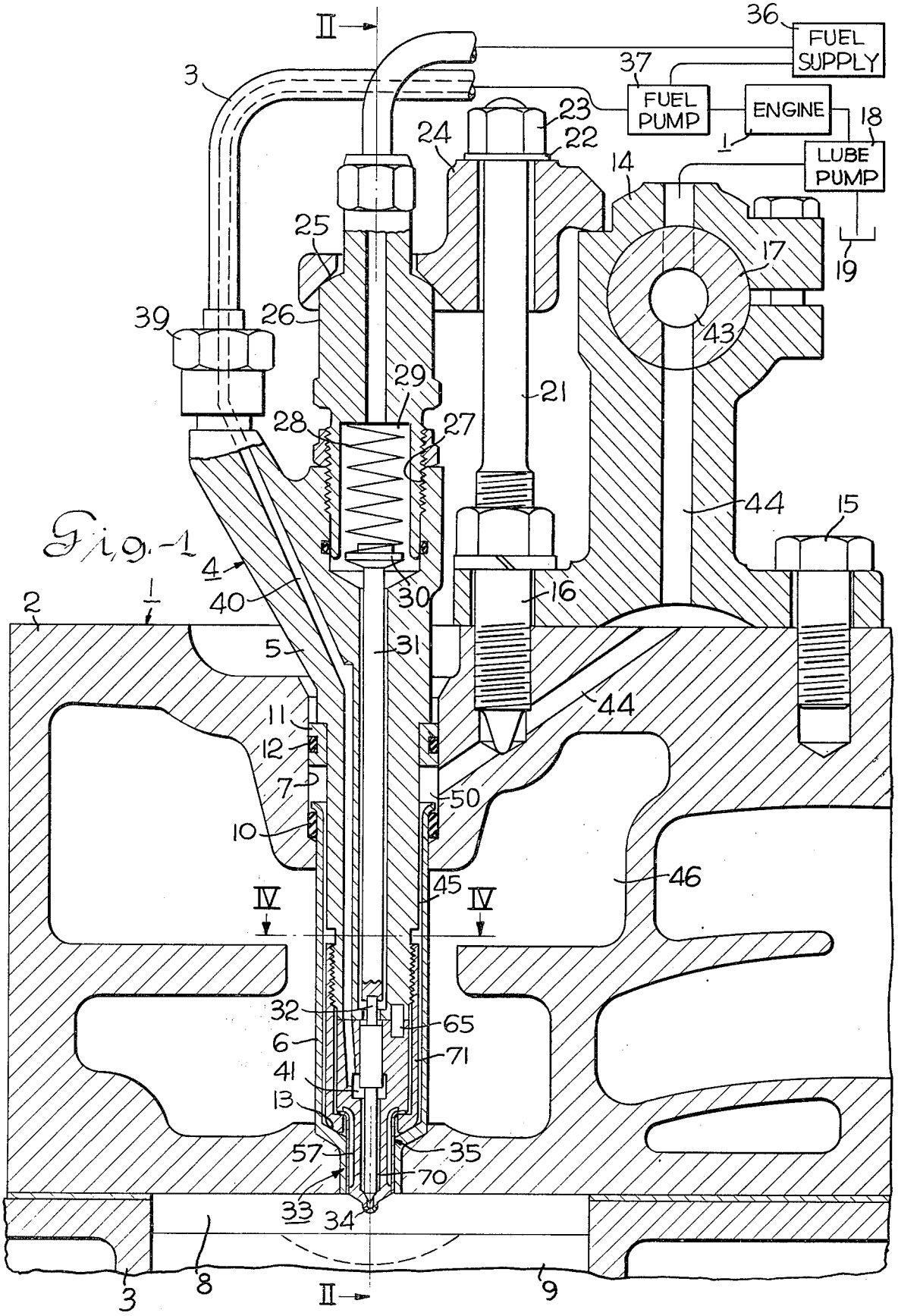
FIG. 1 illustrates a cross section view of the fuel injection nozzle showing the hydraulic cooling fluid circuit and the fuel injection passages.

FIG. 1 shows an internal combustion engine 1 including a head 2 mounted on the cylinder block 3. A fuel injection nozzle 4 is mounted in the head 2. Nozzle 4 includes nozzle holder body 5 received within the tubular jacket 6 seated within the opening 7 of the head 2. The head 2 forms a combustion chamber 8 with the block 3 and the piston 9.

The water jacket 6 is sealed by means of the seal 10 and pressed into the opening 7. The seal retainer 11 embraces the upper portion of the nozzle holder body 5 and receives seal 12 engaging the head 2. Nozzle holder body 5 and nozzle retainer nut 71 extend concentrically within the water jacket 6 forming the peripheral passage 45. Nozzle retainer nut 71 engages the surface 13 to seal the end of the peripheral passage 45.

Figure 2:
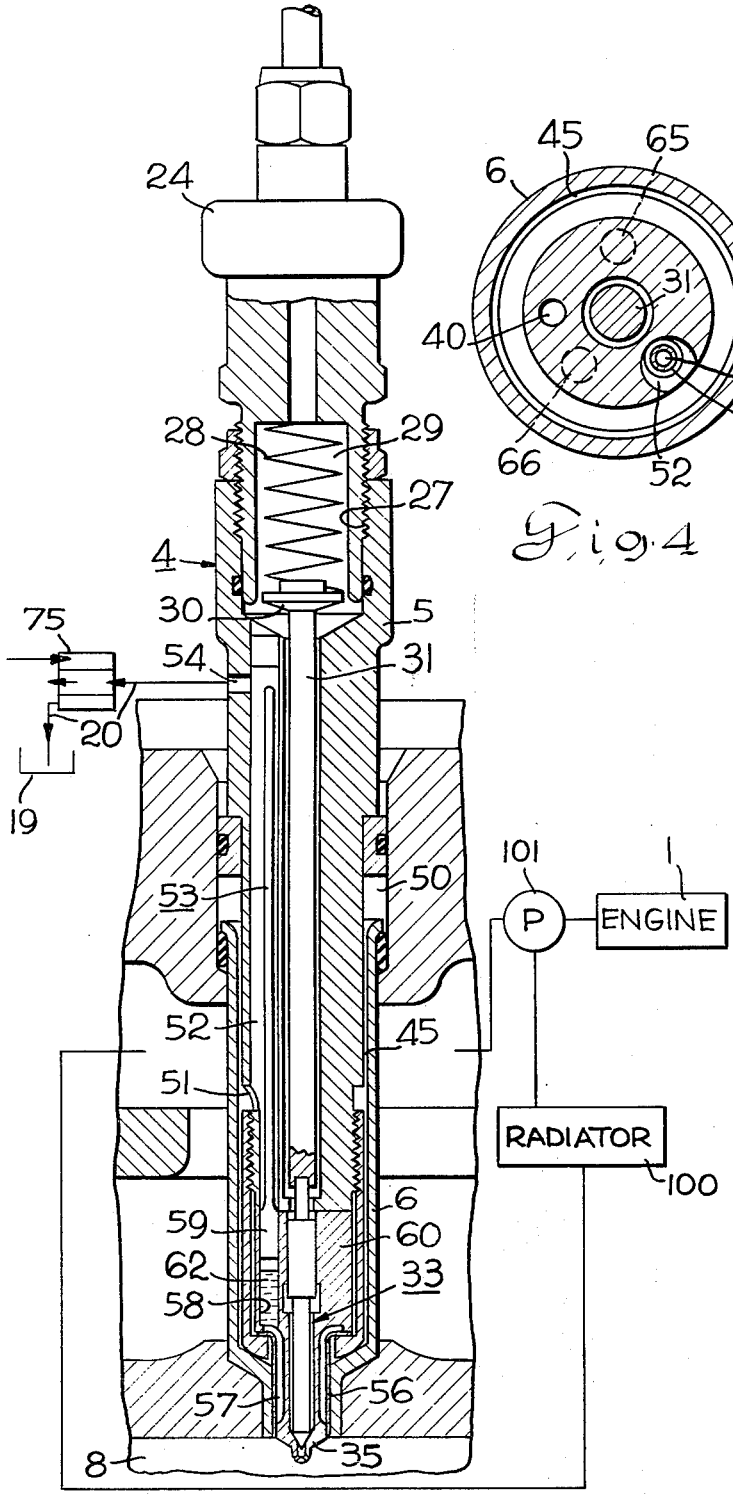
FIG. 2 illustrates a cross section view of the hermetically sealed heat pipe and the hydraulic cooling fluid system taken along lines II—II of FIG. 1.

The rocker shaft bracket 14 is mounted by means of a plurality of bolts 15 and 16 which carries the rocker shaft 17. The rocker shaft 17 receives hydraulic fluid from the pump 18 and the pump 18 receives hydraulic fluid from the reservoir 19 which is pumped through the fuel injection nozzle 4. FIG. 2 shows the heat exchanger 75 for cooling the oil and the return to the reservoir 19 through conduit 20.

FIG. 1 further shows the bolt 16, washer 22 and nut 23 holding the clamp 24 firmly seated on the shoulder 25 of the fuel injection adjusting screw 26. The differential valve adjusting screw 26 threadedly engages a threaded opening 27 on the nozzle holder body 5 and adjustably compresses the spring 28 within the spring chamber 29 which presses against a spring seat 30 of the spindle 31. The spindle 31 engages the end of the needle 32 of the differential valve 33. The differential valve 33 controls the injection of fuel through the orifices 34 in the nozzle tip 35.

The fuel supply 36 supplies fuel to the fuel pump 37 which is pumped through the conduit 38 to the fitting 39 which connects the conduit 38 to the fuel passages 40 in the nozzle holder body 5.

The passage 40 through the nozzle holder body 5 is in communication with the passage 41 of the differential valve 33 in the nozzle tip 35. The engine 1 drives the fuel pump 37 and also the lubrication pump 18. The lubrication pump 18 supplies hydraulic cooling fluid through the central opening 43 of the rocker shaft 17 which in turn is supplied through the passage 44 through the peripheral passage 45 intermediate the water jacket 6 and the nozzle holder body 5. Coolant fluid chamber 46 is in communication with the coolant fluid passages in the engine cooling system including the radiator 100 and coolant fluid pump 101 as shown in FIG. 2. The coolant fluid in the chamber 46 cools the water jacket 6 surrounding the nozzle holder body.

FIG. 2 shows the inlet port 50 in communication with the hydraulic fluid inlet passage 44 and the peripheral passage 45 intermediate the water jacket 6 and the nozzle holder body 5. The peripheral passage 45 receives the hydraulic cooling fluid from the inlet port 50 and fluid circulates around the nozzle holder body and passes through the adjoining port 51 which is intermediate the peripheral passage 45 and the axial passage 52 which receives the heat pipe 53. As the hydraulic fluid passes through the axial passage 52, the heat pipe 53 is cooled and the hydraulic fluid is discharged through the outlet port 54 which then returns through the conduit 20 to the cooling fluid reservoir 19.

The differential valve 33 is positioned in the tip 35 of the nozzle 4. The sleeve 56 surrounds the differential valve 33 and forms a peripheral passage 57 extending through the nozzle tip to a point adjacent the combustion chamber 8. The peripheral passage 57 is in communication with the chamber 58 which receives the base 59 of the heat pipe 53. The base 59 is hermetically sealed in the chamber 58 of nozzle body 60. The peripheral passage 57 is in communication with the chamber 58 and the tubular opening 61 in the heat pipe 53. The central passage 61 and the chamber 58 and the peripheral passage 57 are evacuated and a cooling medium 62 is placed in the lower portion of chamber 58 and of peripheral 57. Cooling medium 62 has the characteristic of a boiling point of a temperature which corresponds to the upper range of the acceptable nozzle operating temperature. For example, for operation on diesel fuel, the desirable temperature of the nozzle tip should not exceed 400°F.

Figure 4:
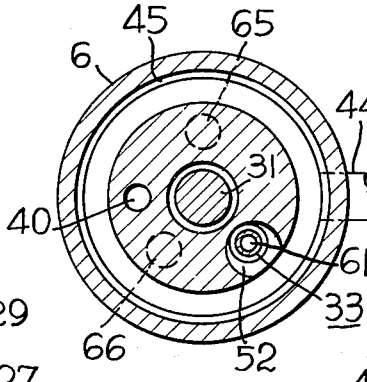
FIG. 4 is a cross section view taken on line IV—IV of FIG. 1.
Figure 3:
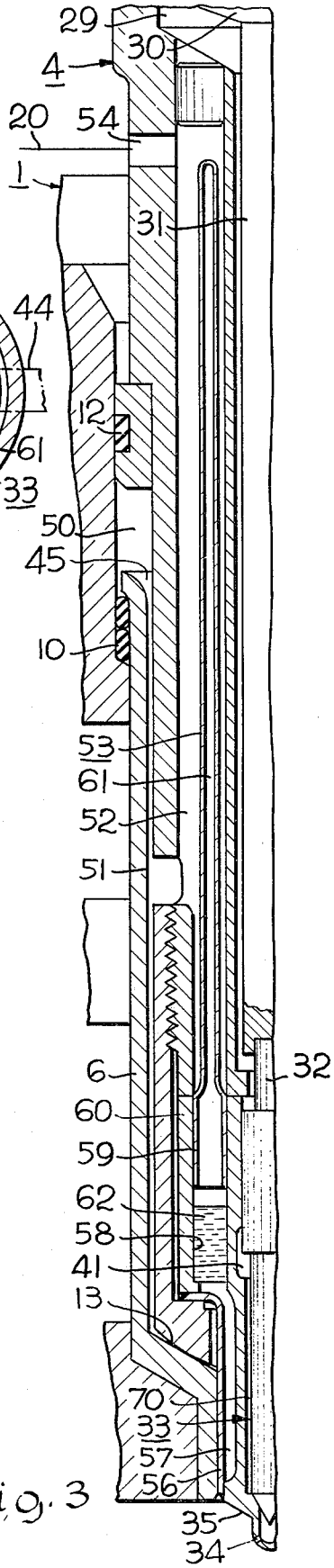
FIG. 3 is an enlarged portion of the section of FIG. 2 to more clearly show the cooling passages.

Referring to FIG. 4, the cross section view shows a pair of dowel pins 65, 66 aligning the nozzle holder body 4 with the nozzle body 60. Only a single axial passage 52 is shown receiving a heat pipe 53. The heat pipe 53 has the central passage 61 which extends the length of the heat pipe and normally contains vaporized cooling medium which will be condensed since heat pipe surfaces are below the condensation point of the cooling medium. The condensate is then returned to the chamber 58 and the peripheral passage 57 where it is again vaporized.

The operation of the device will be described in the following paragraphs.

The engine 1 drives the fuel injection pump 37 which pressurizes fluid which is transmitted through the conduit 38 through passages 40 to the differential valve 33. The differential valve opens and injects fuel into the combustion chamber 8 when a predetermined pressure is reached in the valve chamber 70. The tip 35 of the nozzle 4 is exposed to high temperatures and considerable heat is transferred to the nozzle tip. The peripheral passage 57 containing the cooling medium is heated and causes the medium to vaporize and the vaporized cooling medium passes through the chamber 58 into the central passage 61 in the heat pipe 53. Although only one heat pipe is shown a plurality of heat pipes may be provided angularly spaced about the peripheral passage 57 to dissipate additional heat if desired. The vaporized cooling medium in the heat pipe 53 is exposed to the cooling of the hydraulic fluid in the axial passage 52.

The engine 1 also drives the pump 18 which may be a lubrication oil pump. The hydraulic cooling fluid which is transmitted through the opening 43 in the rocker shaft 17 is transmitted through passage 44 to the peripheral passage 45. The peripheral chamber 45 transmits the fluid to the radial port 51 to the axial passage 52 and the fluid passes through the outlet port 54 to the return conduit 20 to the reservoir 19. As the hydraulic cooling fluid is passing through the axial passage 52, heat is transferred from the heat pipe 53 to the hydraulic cooling fluid. As the heat is transferred to the hydraulic cooling fluid in the axial passage 52, the cooling medium in the heat pipe 53 is condensed and returned through the chamber 58 to the peripheral passage 57. The hydraulic cooling fluid is of the temperature of approximately 200°–300° which is substantially less than the boiling point of the cooling medium in the heat pipe. For the purpose of illustration, it is assumed that the boiling point of the cooling medium is approximately 400°.

Accordingly, the heat generated in the combustion chamber and transmitted to the exposed area of the fuel injector is transmitted to the coolant medium in the peripheral passage 57. The heat is transferred from the peripheral passage by means of the cooling medium to the axial chamber 61 in the heat pipe 53. The heat from the heat pipe 53 is then transferred to the hydraulic cooling fluid. Conduit 20 transmits the cooling fluid through the heat exchanger 75 where heat is dissipated before the fluid is returned to the reservoir 19.

The embodiments of the invention in which an exclusive property or privilege is claimed are defined as follows:

1. A two phase fuel injection nozzle cooling system comprising, an engine forming a combustion chamber, a nozzle including, a nozzle body mounted on said engine, a differential valve mounted on said nozzle body for injecting fuel in said combustion chamber, fuel inlet passage means in said nozzle body connected to said differential valve, said nozzle body defining cooling fluid passages, at least one heat pipe defining a cooling medium passage, means defining cooling medium passages surrounding the differential valve in communication with said cooling medium passage in said heat pipe adapted for receiving a cooling medium having a boiling point in the range of acceptable operating temperatures of the fuel injection nozzle, a hydraulic cooling fluid system including said cooling fluid passages in said nozzle body and surrounding a portion of said heat pipe for operating as a heat sink, means for circulating cooling fluid through said hydraulic system to thereby provide cooling of said nozzle.

2. A two phase fuel injection nozzle cooling system as set forth in claim 1 including means defining a peripheral chamber in said hydraulic cooling system in the periphery of said nozzle body for cooling said nozzle.

3. A two phase fuel injection nozzle cooling system as set forth in claim 1 wherein said hydraulic cooling medium passages in said nozzle body include a peripheral passage encircling said differential valve extending to a point adjacent said combustion chamber.

4. A two phase fuel injection nozzle cooling system as set forth in claim 1 including a plurality of heat pipes having a cooling medium passage in communication with said cooling medium passages in said nozzle.

5. A two phase fuel injection nozzle cooling system as set forth in claim 1 including a water jacket surrounding said nozzle body and defining a peripheral chamber in said hydraulic system surrounding said nozzle body for cooling of the nozzle assembly.

6. A two phase fuel injection nozzle cooling system as set forth in claim 1 including a tubular water jacket surrounding said nozzle body, means defining a chamber adapted for connection to an engine cooling system for cooling said water jacket and said nozzle.

7. A two phase fuel injection nozzle cooling system as set forth in claim 1 wherein said heat pipe defines a tubular stem forming a central sealed cooling medium passage extending into said hydraulic cooling fluid system.

8. A two phase fuel injection nozzle cooling system as set forth in claim 1 wherein said hydraulic cooling fluid system includes an engine lubricating system.

9. A two phase fuel injection nozzle cooling system as set forth in claim 1 including means defining a peripheral passage surrounding said nozzle body in said hydraulic cooling fluid system, means defining an inlet port and an outlet port in said hydraulic cooling fluid system, means defining an axial passage in said hydraulic cooling fluid system receiving said heat pipe and for conveying hydraulic cooling fluid through said nozzle body for cooling said heat pipe.

10. A two phase fuel injection nozzle cooling system as set forth in claim 1 including means defining a peripheral cooling medium passage surrounding said differential valve for boiling a coolant medium in said heat pipe, an axial passage in said heat pipe connected for receiving vaporized fluid from said peripheral cooling medium passage for producing condensate in response to heat transfer to said hydraulic cooling fluid.

11. A two phase fuel injection nozzle cooling system as set forth in claim 1 including, means defining a peripheral cooling medium passage surrounding said differential valve adjacent to said combustion chamber, means defining an axial cooling fluid passage in said hydraulic cooling fluid system, a tubular stem hermetically sealed in said axial cooling fluid passage defining said heat pipe, a connecting passage connecting said peripheral cooling medium passage in communication with said cooling medium passage in said heat pipe to provide transfer of heat from said nozzle to said hydraulic cooling fluid system.

* * * * *